US007042400B2

(12) United States Patent
Okubo et al.

(10) Patent No.: US 7,042,400 B2
(45) Date of Patent: May 9, 2006

(54) MULTI-FREQUENCY ANTENNA

(75) Inventors: Katsutoshi Okubo, Gunma (JP); Tadashi Oshiyama, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 10/980,240

(22) Filed: Nov. 4, 2004

(65) Prior Publication Data

US 2005/0099344 A1 May 12, 2005

(30) Foreign Application Priority Data

Nov. 6, 2003 (JP) ..... P2003-376482

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 5,880,694 | A | 3/1999 | Wang et al. | 343/700 MS |
| 5,952,972 | A * | 9/1999 | Ittipiboon et al. | 343/700 MS |
| 6,501,425 | B1 | 12/2002 | Nagumo et al. | 343/700 MS |
| 6,618,014 | B1 * | 9/2003 | Stoiljkovic et al. | 343/702 |
| 6,788,257 | B1 * | 9/2004 | Fang et al. | 343/700 MS |
| 2004/0150563 | A1 | 8/2004 | Oshiyama et al. | 343/700 MS |

FOREIGN PATENT DOCUMENTS

| | | |
|---|---|---|
| EP | 0 886 336 A2 | 12/1998 |
| EP | 1 139 490 A1 | 10/2001 |
| WO | WO 02/089249 A1 | 11/2002 |

OTHER PUBLICATIONS

Mohamed Sanad et al., "Mobile Cellular/GPS/Satellite Antennas with Both Single-Band and Dual-Band Feed Points," *IEEE Antennas and Propagation Society International Symposium, 2000 Digest*, New York, NY, vol. 1, Jul. 16, 2000, pp. 298-301.

* cited by examiner

*Primary Examiner*—Tan Ho
(74) *Attorney, Agent, or Firm*—Morgan, Lewis & Bockius LLP

(57) ABSTRACT

A dielectric carrier is disposed on a substrate and formed with a recess. A first antenna element is provided on at least one face of the carrier and electrically connected to the substrate. A second antenna element is provided as a ceramic antenna and disposed in the recess. A first dielectric layer is provided between the first antenna element and the second antenna element. A second dielectric layer is provided between the substrate and the second antenna element. The recess is formed at a position which is sufficiently away from a power supply point to the first antenna element and a point at which a potential of the first antenna element has a maximum value.

6 Claims, 8 Drawing Sheets

MULTI-FREQUENCY ANTENNA

BACKGROUND OF THE INVENTION

The present invention relates to an antenna for a mobile communications terminal, and more particularly, to a multi-frequency antenna capable of communicating signals having a plurality of frequencies: used for mobile phones and data communications, etc.

In recent years, the mobile communication has made a rapid progress. Especially, the mobile phones have significantly come into widespread use, and reduction in size and weight have been achieved. In case of the mobile phone, a dual band is becoming a main stream in respective areas of the world, for example, PDC (Personal Digital Cellular) 800 MHz band and PDC 1.5 GHz band in Japan, GSM (Global System for Mobile Communications) 900 MHz band and GSM 1.8 GHz band in Europe, and AMPS (Advanced Mobile Phone Service) 800 MHz band and PCS (Personal Communication Services) 1.9 GHz band in North America. In addition, communication systems such as GPS (Global Positioning System) of 1.5 GHz band, Bluetooth of 2.4 GHz band, IMT (International Mobile Telecommunication) 2000 of 2 GHz band are becoming widespread. Under the circumstances, in order to conduct these mobile phones and communication systems in a single apparatus for the mobile communications, antennas adapted to respective frequency bands need to be provided in the single apparatus.

FIG. 8 shows a first related-art in which an apparatus incorporates an antenna for the dual band of AMPS/PCS for the mobile phone and an antenna for the GPS. Such a configuration is disclosed in International Patent Publication No. WO 02/89249.

A carrier 12 made of dielectric substance is disposed on a substrate 10, and a first antenna element 14 for the dual band of AMPS/PCS made of sheet metal is disposed on an upper face of this carrier 12. Further, a second antenna element 16 for the GPS made of sheet metal is disposed on a side face of the carrier 12. Numerals 14*a* and 14*b* designate a power supply terminal and a grounding terminal of the first antenna element 14, respectively. Numerals 16*a* and 16*b* designate a power supply terminal and a grounding terminal of the second antenna element 16, respectively.

FIG. 9 shows a second related-art apparatus incorporating an antenna for the dual band for the mobile phone and an antenna for the GPS. The elements similar to those in the first related-art will be designated by the same reference numerals, and repetitive explanations will be omitted.

In this example, a carrier 12 which is smaller than the carrier shown in FIG. 8 is disposed on a substrate 10, and a first antenna element 14 for the dual band made of sheet metal is disposed on an upper face of the carrier 12. Further, a second antenna element 16 for the GPS made of sheet metal or conductive foil is disposed on the substrate 10 near the carrier 12, along two side faces of the carrier 12.

FIG. 10 shows a third related-art apparatus incorporating an antenna for the dual band for the mobile phone and an antenna for the GPS. The elements similar to those in the first related-art will be designated by the same reference numerals, and repetitive explanations will be omitted.

In this example, a carrier 12 which is smaller than the carrier shown in FIG. 8 is disposed on a substrate 10, and a first antenna element 14 for the dual band made of sheet metal is disposed on an upper face of the carrier 12. Further, a ceramic antenna 18 for the GPS is disposed on the substrate 10 near the carrier 12.

In the first related-art shown in FIG. 8, high gain can be obtained, because the structure is simple and the first antenna element 14 has a large area. However, the largest point of electric voltage of the second antenna element 16 is located close to the first antenna element 14, and also, the largest point of electric voltage of the first antenna element 14 is located close to the second antenna element 16. For this reason, interference occurs between them, which will make isolation worse. Because of the worse isolation, there has been such disadvantage that the gain and the voltage standing wave ratio (VSWR) may be decreased. In view of the above, it has been considered that the signals to be received by the first and second antenna elements 14, 16 should be separated by a filter. However, this leads to a problem that an area for mounting the filter and cost for components are required.

In the second related-art shown in FIG. 9, the first and second antenna elements 14, 16 can be disposed relatively spaced from each other, and the isolation can be improved, enabling the gain and VSWR to be enhanced in this respect. However, the substrate 10 to be incorporated in the mobile phone or the like has a limited size, and so, in order to provide the second antenna element 16 on the substrate 10, the area of the first element 14 must be made smaller than that in the first related-art shown in FIG. 8. Consequently, the gain will be inevitably decreased, because the area of the first antenna element 14 has been made smaller.

In the third related-art shown in FIG. 10, the first antenna element 14 and the ceramic antenna 18 must be sufficiently spaced from each other in order to eliminate interference between them, and for this reason, the area of the first antenna element 14 will be made smaller, resulting in decrease of the gain. Moreover, because the ceramic antenna 18 has a high Q value, even a slight deviation of resonant frequency of the ceramic antenna 18 from the frequency of the GPS signal which is being received will cause a remarkable drop of the gain. Further, because the resonant frequency of the ceramic antenna 18 will be largely affected by metallic conductors in surrounding areas, it is necessary to check the resonant frequency of the ceramic antenna 18, in a state where other circuit components in addition to the first antenna element 14 and the ceramic antenna 18 have been mounted on the substrate 10. This will be a disadvantage when a trouble has happened. Still further, in case where a terminal of the ceramic antenna 18 is fixed by soldering to the conductive foil on the substrate 10 and electrically connected thereto, there is an anxiety that the soldered foil may be removed from the substrate 10 with vibrations or shocks, and reliability will be lost in both electrical and mechanical features.

SUMMARY OF THE INVENTION

It is therefore an object of the invention to provide a multi-frequency antenna which can attain better isolation between respective elements by eliminating relative interferences, and can obtain excellent gain and VSWR.

In order to achieve the above object, according to the invention, there is provided an antenna, comprising:

a substrate;

a dielectric carrier, disposed on the substrate and formed with a recess;

a first antenna element, provided on at least one face of the carrier and electrically connected to the substrate;

a second antenna element, provided as a ceramic antenna and disposed in the recess;

a first dielectric layer, provided between the first antenna element and the second antenna element; and a second dielectric layer, provided between the substrate and the second antenna element, wherein the recess is formed at a position which is sufficiently away from a power supply point to the first antenna element and a point at which a potential of the first antenna element has a maximum value.

With this configuration, since the second antenna element is disposed in the recess formed in the carrier, the first antenna element can be provided making use of a size of the substrate to the largest extent, thereby to obtain a large area. As a result, the gain will be increased. Moreover, since the position of the recess is arranged as described the above, an excellent isolation can be obtained without relative interference between the first and second antenna elements. Further, since the dielectric layers are arranged as described the above, it is possible to decrease the Q value of the ceramic antenna thereby enlarging the band width of the ceramic antenna. Therefore, even though the resonant frequency of the ceramic antenna deviates from the signal to be received, a significant drop of the gain can be avoided.

Preferably, at least one of the first dielectric layer and the second dielectric layer is provided as an air layer.

In this case, it is easy to appropriately regulate the Q value of the ceramic antenna, by adequately setting thicknesses of the air layer.

Preferably, the second antenna element is electrically connected to the substrate by way of a spring connector.

In this case, the electrical connection between the ceramic antenna and the substrate will not be broken with vibrations or shocks.

Preferably, a dielectric holder disposed between the recess and the substrate so as to clamp the second antenna element together with the carrier.

In this case, it is possible to effectively conduct tests or the like of antenna characteristics of the first and second antenna elements, prior to assembling them to the substrate.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1C:
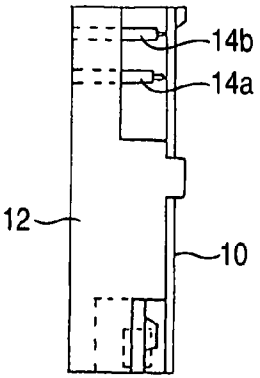
FIG. 1C is a side view of the antenna of the invention.

One embodiment of the invention will be described with reference to the accompanying drawings. The elements similar to those in the related-art configurations will be designated by the same reference numerals, and repetitive explanations will be omitted.

Figure 1A:
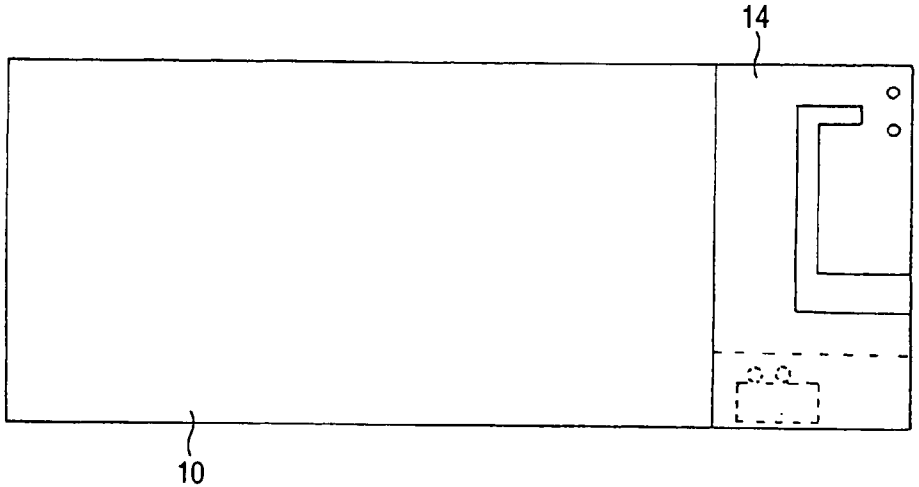
FIG. 1A is top view of a multi-frequency antenna according to one embodiment of the invention.
Figure 1B:
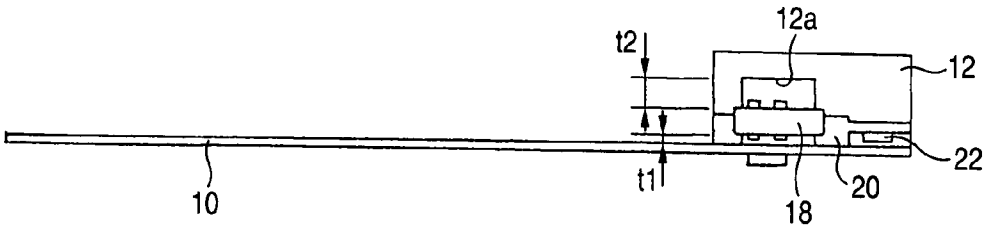
FIG. 1B is a front view of the antenna of the invention.
Figure 8:
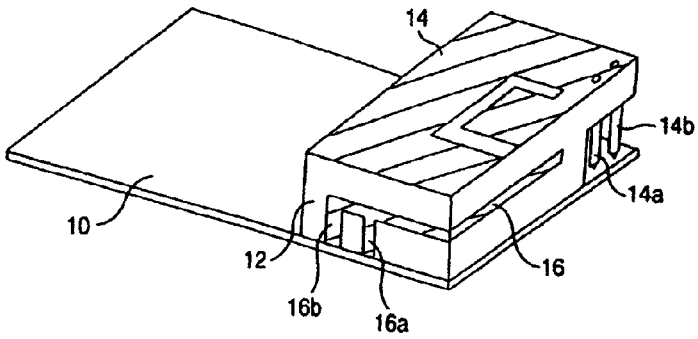
FIG. 8 (Prior Art)
FIG. 8 is a perspective view of a first related-art antenna.
Figure 9:
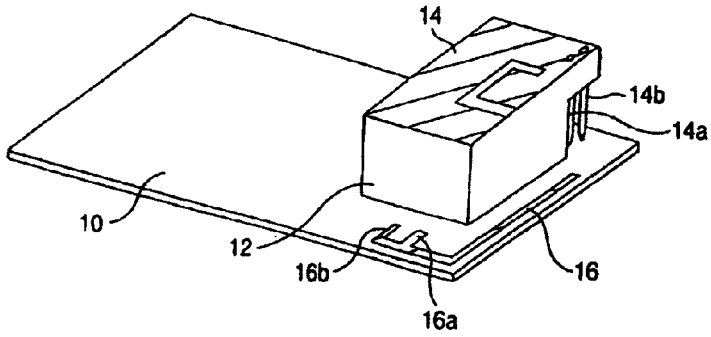
FIG. 9 (Prior Art)
FIG. 9 is a perspective view of a second related-art antenna.
Figure 10:
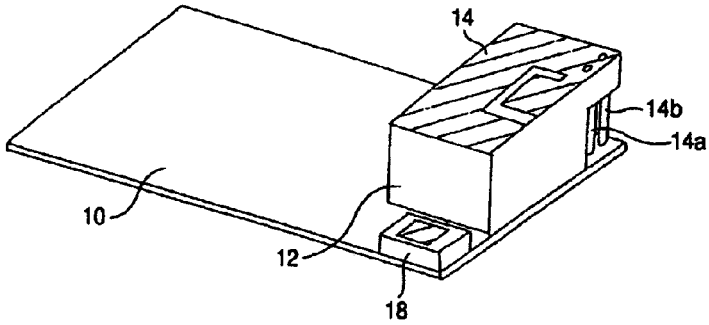
FIG. 10 (Prior Art)
FIG. 10 is a perspective view of a third related-art antenna.

A substrate 10 (e.g., having a size of 104 mm×40 mm) shown in FIG. 1 is configured to be incorporated in a mobile phone. A carrier 12 made of a dielectric substance (e.g., having a dielectric constant of 3.5) is disposed on one surface of the substrate 10. A first antenna element 14 similar to that shown in FIG. 8 is disposed on an upper face of this carrier 12. In this embodiment, a ceramic antenna 18 is disposed in a recess 12*a* which is formed on a side face of the carrier 12 at a position which is sufficiently away from a power supply part and the largest voltage point of the first antenna element 14. In this case, the largest voltage point of the first antenna element 14 is located at a tip end of the element having a long electric path length where a low frequency band (AMPS) resonates and at a tip end of the element having a short electric path length where a high frequency band (PCS) resonates. The power supply part of the first antenna element 14 is a part where a power supply terminal 14*a* composed of a spring connector is provided (see FIG. 1C), and this part is the largest point of electric current. A grounding terminal 14*b* is also composed of a spring connector. In this embodiment, by arranging the ceramic antenna 18 apart from either of the largest voltage point and the largest current point of the first antenna element 14 as remote as possible, the relative interference can be reduced to the least.

Figure 2:
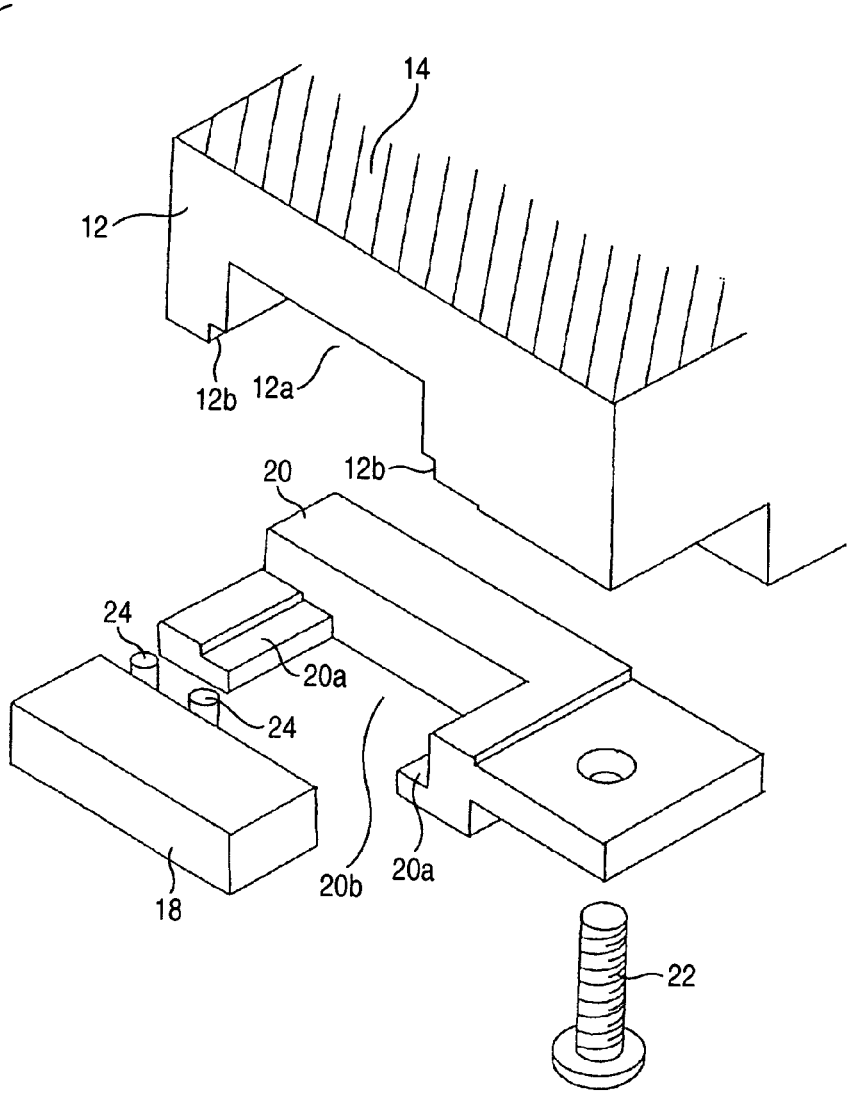
FIG. 2 is a perspective view showing a disassembled state of an essential portion of the antenna of the invention.

As shown in FIG. 2, the recess 12*a* of the carrier 12 is formed with stepped portion 12*b* for supporting upper corner portions of the ceramic antenna 18. On the other hand, a holder 20 formed of resin is formed with stepped portions 20*a* for supporting lower corner portions of the ceramic antenna 18, so as to be opposed to the stepped portions 12*b* of the carrier 12. The holder 20 is appropriately fixed to the carrier 12 by a fitting screw 22, in a state where the ceramic antenna 18 is clamped between the stepped portions 12*b* of the carrier 12 and the stepped portions 20*a* of the holder 20. In this case, it is desirable that the ceramic antenna 18 is arranged as close as possible to an edge of the carrier 12. The holder 20 is provided with a cutout 20*b* so as to form an air gap below a lower face of the ceramic antenna 18, in a state where this ceramic antenna 18 has been fixed to the carrier 12. Incidentally, the recess 12*a* forms an air gap above an upper face of the ceramic antenna 18. In the assembled state shown in FIG. 1B, an air layer having a thickness of t1 exists between the lower face of the ceramic antenna 18 and the substrate 10, and an air layer having a thickness of t2 exists between the upper face of the ceramic antenna 18 and the carrier 12. For instance, a height of the carrier 12 is 10 mm, a thickness of the ceramic antenna 18 is 3 mm, t1 is 1 mm, and t2 is 3 mm.

Figure 3A:
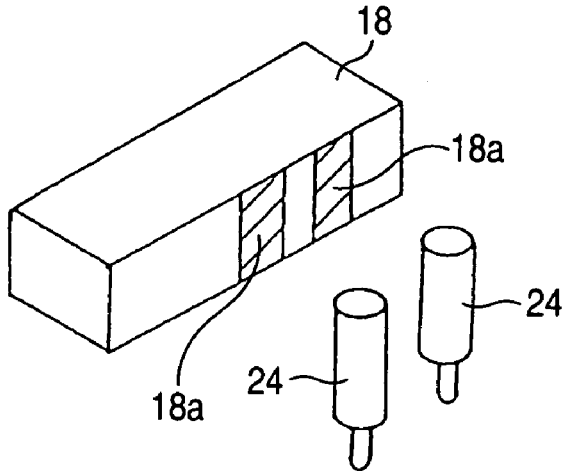
FIG. 3A is a perspective view showing a disassembled state of a ceramic antenna incorporated in the antenna of the invention.
Figure 3B:
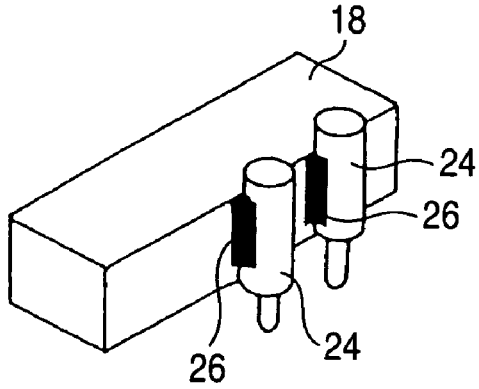
FIG. 3B is a perspective view showing an assembled state of the ceramic antenna.

As shown in FIG. 3A, the ceramic antenna 18 is provided with terminal electrodes 18*a*, on its side face thereof, and spring connectors 24 are fixed to these terminal electrodes 18*a* by soldering, as shown in FIG. 3B. In the assembled state shown in FIGS. 1A to 1C, the ceramic antenna 18 is electrically connected to the substrate 10 by way of the spring connectors 24.

Figure 4:
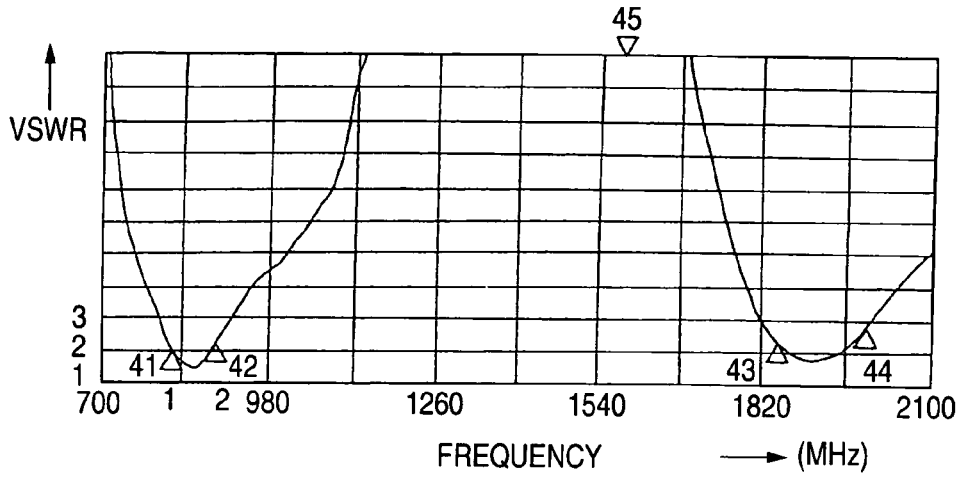
FIG. 4 is a graph showing a VSWR characteristics of a first antenna element in the antenna of the invention.

With the above configuration, the VSWR less than 3 can be obtained by the first antenna element 14 in either of the AMPS of 824 to 894 MHz band and the PCS of 1850 to 1990 MHz band, as shown in FIG. 4. Specific experimental data are shown in Table 1.

TABLE 1

| point in graph | frequency [MHz] | VSWR |
|---|---|---|
| 41 | 824 | 1.9202 |
| 42 | 894 | 2.0966 |
| 43 | 1850 | 2.2788 |
| 44 | 1990 | 2.8018 |
| 45 | 1575 | 28.031 |

Figure 5:
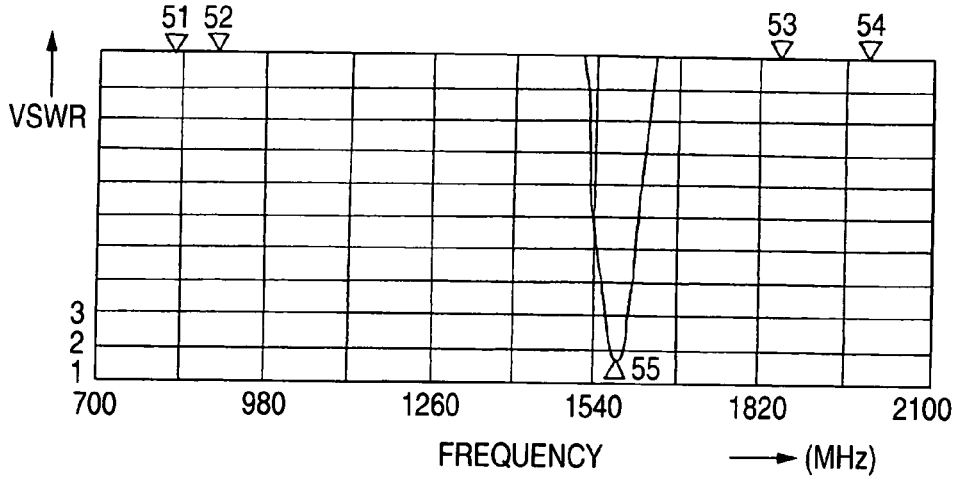
FIG. 5 is a graph showing a VSWR characteristics of the ceramic antenna.

As shown in FIG. 5, an excellent VSWR characteristic less than 2 can be obtained by the ceramic antenna 18, in response to a GPS signal of 1575 MHz. Specific experimental data are shown in Table 2.

TABLE 2

| point in graph | frequency [MHz] | VSWR |
|---|---|---|
| 51 | 824 | 52.777 |
| 52 | 894 | 49.261 |
| 53 | 1850 | 29.200 |
| 54 | 1990 | 30.805 |
| 55 | 1575 | 1.3372 |

Figure 6:
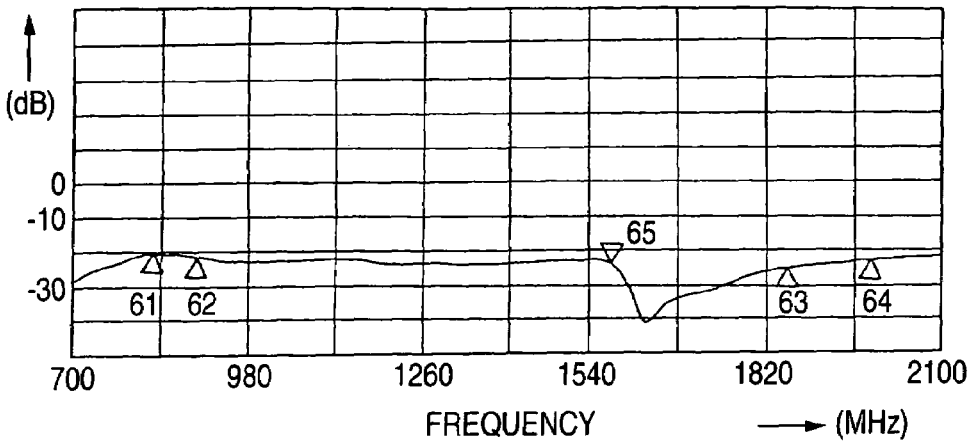
FIG. 6 is a graph showing an isolation characteristics between the first antenna element and the ceramic antenna.

As shown in FIG. 6, it has been confirmed that the isolation between the first antenna element 14 and the ceramic antenna 18 is below −20 dB in any frequency band of the AMPS, PCS and GPS, and there is no relative interference between them, in practical use. Specific experimental data are shown in Table 3.

TABLE 3

| point in graph | frequency [MHz] | isolation [dB] |
|---|---|---|
| 61 | 824 | −20.534 |
| 62 | 894 | −21.807 |
| 63 | 1850 | −25.712 |
| 64 | 1990 | −23.138 |
| 65 | 1575 | −23.759 |

Figure 7A:
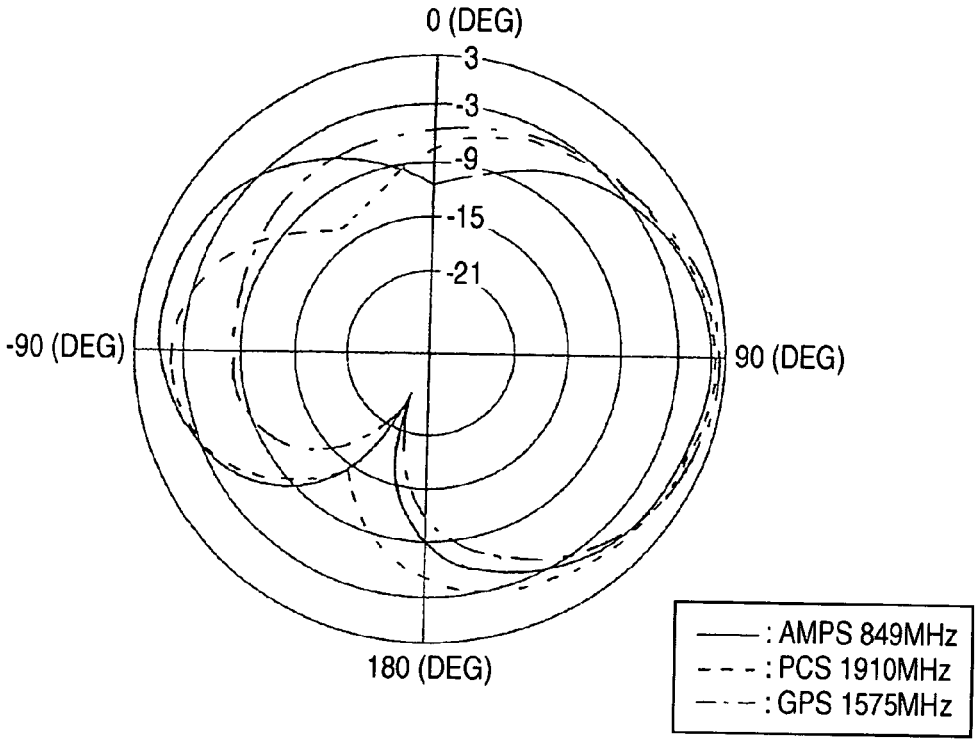
FIG. 7A is a graph showing a directivity characteristics of the first antenna element and the ceramic antenna.
Figure 7B:
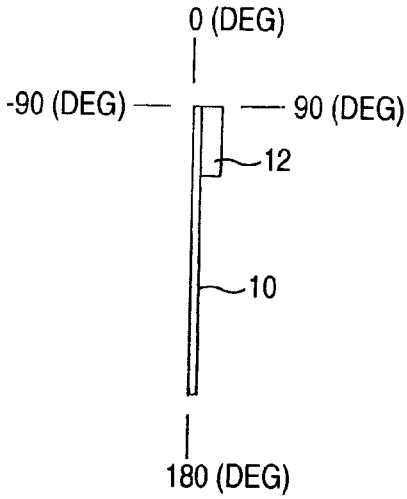
FIG. 7B is a side view of the antenna for understanding the graph of FIG. 7A.

FIG. 7A shows the directivity of the first element 14 in a state where the antenna is viewed as shown in FIG. 7B. Specifically, the largest gain of 0.85 dBi and an average gain of −2.42 dBi with respect to the AMPS of 849 MHz have been obtained by the first antenna element 14, while the largest gain of 1.18 dBi and an average gain of −2.28 dBi with respect to the PCS of 1910 MHz have been obtained by the first element 14. On the other hand, the largest gain of 2.16 dBi and an average gain of −2.85 dBi with respect to the GPS signal of 1575 MHz have been obtained by the ceramic antenna 18. It is to be noted that the AMPS and PCS have been measured by signals of linearly polarized waves, and the GPS has been measured by signals of circularly polarized waves.

The air layer formed between the lower face of the ceramic antenna 18 and the substrate 10 contributes to lower the Q value of the ceramic antenna 18, thereby enlarging the band width of the antenna. It is also possible to appropriately and minutely regulate the Q value, by adequately adjusting the thickness t1 of the air layer, or by providing a dielectric substance layer having a low dielectric constant between the lower face of the ceramic antenna 18 and the substrate 10. For example, the holder 20 may be formed of such a dielectric substance without forming the cutout 20*b*. In this case, since the entirety of the lower face of the ceramic antenna 18 is covered with the holder 20, the ceramic antenna 18 will be protected from vibrations or shocks.

Moreover, the air layer formed between the upper face of the ceramic antenna 18 and the lower face of the recess 12*a* of the carrier 12 contributes to eliminate such phenomenon that the relative interference may occur between the first antenna element 14 and the ceramic antenna 18 by way of the carrier 12, because the air layer serves as a dielectric layer having a low dielectric constant.

The carrier 12 above the upper face of the ceramic antenna 18 may be cut away, so that the air layer may be formed all the way to the first antenna element 14, if the antenna element 14 can be reliably supported.

Since the ceramic antenna 18 is electrically connected to the substrate 10 by way of the spring connectors 24, vibrations or shocks will be absorbed by the spring connectors 24 and the electrical connection will not be broken. Hence, reliability of the antenna will be enhanced.

In this embodiment, the ceramic antenna 18 is clamped between the carrier 12 and the holder 20. However, the holder 20 may be configured to independently holding the ceramic antenna, and to be disposed in the recess 12*a* of the carrier 12.

The first antenna element 14 may be configured to communicate the signals of dual band for the mobile phone other than the AMPS/PCT, and the ceramic antenna 18 may be configured to communicate the signals of the Bluetooth and IMT2000.

The electrical connection between the ceramic antenna 18 and the substrate 10 may be made by employing an elastically deformable member such as a leaf spring made of conductive metal.

What is claimed is:

1. An antenna, comprising:

a substrate;

a dielectric carrier, disposed on the substrate and formed with a recess;

a first antenna element, provided on at least one face of the carrier and electrically connected to the substrate;

a second antenna element, provided as a ceramic antenna and disposed in the recess;

a first dielectric layer, provided between the first antenna element and the second antenna element; and a second dielectric layer, provided between the substrate and the second antenna element, wherein the recess is formed at a position which is sufficiently away from a power supply point to the first antenna element and a point at which a potential of the first antenna element has a maximum value.

2. The antenna as set forth in claim 1, wherein at least one of the first dielectric layer and the second dielectric layer is provided as an air layer.

3. The antenna as set forth in claim 1, wherein the second antenna element is electrically connected to the substrate by way of a spring connector.

4. The antenna as set forth in claim 1, further comprising a dielectric holder disposed between the recess and the substrate so as to clamp the second antenna element together with the carrier.

5. The antenna as set forth in claim 1, wherein the first antenna element is adapted to communicate signals in a frequency band for mobile phone communications, and the second antenna element is adapted to receive GPS signals.

6. The antenna as set forth in claim 1, wherein:

the first antenna element is adapted to communicate signals of either dual frequency band for mobile phone communications selected from PDC 800 MHz band and PDC 1.5 GHz band, GSM 900 MHz band and GSM 1.8 MHz band, and AMPS 800 MHz band and PCS 1.9 GHz band; and the second antenna element is adapted either to receive GPS signals of 1.5 GHz band, to communicate Bluetooth signals of 2.4 GHz band, or to communicate IMT2000 signals of 2 GHz band.

* * * * *